US005413382A

United States Patent [19]

Cornell et al.

[11] Patent Number: 5,413,382

[45] Date of Patent: May 9, 1995

[54] CLIPBOARD

[75] Inventors: Stephen R. Cornell, Middleborough; Robert G. Cornell, Duxbury, both of Mass.

[73] Assignee: Cornell Concepts Corporation, East Taunton, Mass.

[21] Appl. No.: 184,831

[22] Filed: Jan. 21, 1994

[51] Int. Cl.[6] ..... B42D 3/00

[52] U.S. Cl. ..... 281/45; 281/42; 281/51

[58] Field of Search ..... 281/42, 45, 15.1, 44, 281/28, 51; 24/67.1, 67.11; 248/444.1, 450, 451, 452

[56] References Cited

U.S. PATENT DOCUMENTS

| | | | |
|---|---|---|---|
| D. 164,173 | 8/1951 | Ives . | |
| D. 182,577 | 4/1958 | Flemming . | |
| D. 198,417 | 6/1964 | McFadyen . | |
| D. 209,488 | 12/1967 | Wakai . | |
| D. 235,866 | 7/1975 | Seitz . | |
| D. 284,976 | 8/1986 | Hung . | |
| D. 330,915 | 11/1992 | Shing-Wai . | |
| D. 331,263 | 11/1992 | Shing-Wai . | |
| D. 332,114 | 12/1992 | Offenhauer et al. . | |
| 2,693,370 | 11/1954 | Wheatley . | |
| 3,795,953 | 3/1974 | Voitik . | |
| 4,375,296 | 3/1983 | Chang . | |
| 4,531,642 | 7/1985 | Racich . | |
| 4,628,572 | 12/1986 | Chang . | |
| 4,645,163 | 2/1987 | Zovar . | |
| 4,948,172 | 8/1990 | Chang . | |
| 5,116,012 | 5/1992 | Offenhauer et al. . | |
| 5,145,141 | 9/1992 | Hunter | 248/444.1 X |
| 5,226,215 | 7/1993 | Evenson | 281/45 X |

FOREIGN PATENT DOCUMENTS 448072 4/1948 Canada .

OTHER PUBLICATIONS

Media File, "Keep Your Message Within Reach With Manylord Desk Accessories", p. 440, 1985.

IS, "The Executive Collection", pp. 3–7, 1986–1987.

Dina Line, "Portfolios and Clipboards", p. 25, 1993–1994.

Planner Workbook, "Calcu-Time . . . The Right Answer to Profits", p. 281, 1989–1990.

Planner Workbook, "Create Electricity Between you and your Customers . . . and Watch your Promotion Sizzle", p. 301, 1989–1990.

Sweda, "Calculator Rulers/Clips", p. 38, 1988–1989.

*Primary Examiner*—Willmon Fridie

*Attorney, Agent, or Firm*—Fish & Richardson

[57] ABSTRACT

A clipboard the clip of which is configured as a housing with a lid that is selectively movable between a closed position, in which the lid prevents access to an object stored in the housing, and an open position in which the lid allows the stored object to be accessed. The clipboard also features an assembly for pivotally mounting the clip to the board. The mounting assembly includes at least one post integrally formed with the board, and at least one clasp disposed on the clip and constructed to resiliently grasp a portion of the post and permit the clip to pivot thereabout. A frame is supported by the board and has dimensions selected to receive an object for display to a user. A transparent plate retains the object within the frame and is removable to allow the object to be replaced. The clipboard also includes one or more members for removably attaching a writing implement (such as a pen or a pencil) to the board.

32 Claims, 3 Drawing Sheets

CLIPBOARD

BACKGROUND OF THE INVENTION

This invention relates to clipboards.

A clipboard typically includes a thin, rectangular board sufficiently large in length and width to support one or more sheets of paper. The sheets are resiliently clamped against the upper surface of the board by a spring-loaded clip mounted on one end of the board.

Some clipboard clips serve purposes other than simply clamping paper. For example, some clips carry a light on the upper surface of the clip for illuminating the clamped paper. Other clips are constructed to support, e.g., a calculator on the upper surface of the clip and continuously expose the calculator buttons and display for handy access by the user. Still other clips serve as dispensers for paper articles (such as a stack of fan-folded memo sheets), and include a slot in their upper surface through which a paper article protrudes for removal by the user.

SUMMARY OF THE INVENTION

This invention features, in one general aspect, a clipboard the clip of which is configured as a housing having a lid that is selectively movable between a closed position, in which the lid prevents access to an object stored in the housing, and an open position in which the lid allows the stored object to be accessed.

The clip can be used to store several different objects and types of objects, and is thus much more practical and handy than clips that are dedicated to carrying a single type of object (e.g., paper articles). For example, the clip holds electronic devices (such as calculators and clocks), paper articles (e.g., one or more stacks of memo sheets and business cards), and other accessories such as paper clips and keys, as well as a myriad of combinations of these accessories.

In addition, the clip protects the stored objects from becoming soiled or damaged (e.g., by dust or water) while also providing a measure of security for the objects by shielding the objects from view.

Preferred embodiments include the following features.

The housing comprises a base to which the lid is pivotally mounted for movement between the closed and open positions. The base is equipped with pads for engaging the paper. The lid and the base each include at least one compartment therein for storing at least one object. Preferably, multiple compartments are provided in the lid and the base. The compartments have different dimensions to accommodate different types of objects.

The base includes at least one opening therein to facilitate access to stored paper articles when the lid is in the open position. The housing is also equipped with at least one tab for engaging a stack of memo sheets to retain the stack within the housing when said lid is open. The clip is also constructed to retain stored electronic devices and other accessories within the housing when the lid is open. For example, a magnet is disposed within the housing for retaining metal paper clips.

The lid is mounted to the base with a plurality of hinges. At least one of the hinges includes a pin on the base for engaging a hole disposed in an inclined mounting surface on the lid. The pin has an inclined surface that corresponds to the inclined mounting surface to facilitate attachment of the lid to the base. Among other advantages, this construction avoids the need for separate, press-fit pivot pins.

In another aspect of the invention, an assembly for pivotally mounting the clip to the board includes at least one post integrally formed with the board, and at least one clasp disposed on the clip and constructed to resiliently grasp a portion of the post and permit the clip to pivot thereabout.

This construction eliminates the need for a separate pivot pin for the clip. As a result, assembly is simplified, as is the procedure for replacing the clip, should this become necessary.

Preferred embodiments include the following features.

The portion of the post engaged by the clasp includes a pin disposed along an axis parallel to a surface of the board. A second post-clasp assembly is included. The pins of the posts face each other to help retain clip. A spring is disposed between the clip and the board surface for resiliently urging a portion of the clip against the surface to clamp the paper to the board. The spring is retained in place between the clip and board.

In yet another aspect, the invention features a frame supported by the board and having dimensions selected to receive an object for display to a user, and a transparent plate for retaining the object within the frame.

This feature allows the clipboard to become a reference source for valuable information. For example, the object may be a chart or graph to which the user often refers. Rather than requiring the user to clip the chart to the board along with other sheets of paper, the user can simply load the chart in frame and refer to it as needed.

Preferred embodiments include the following features.

The frame is constructed to retain the transparent plate while allowing the transparent plate to be removed so that the object can be replaced. Thus, as charts or other information become outdated, they may be discarded and replaced. The frame is disposed on a surface of the board opposite to the surface to which paper is clamped by the clip.

In any of the aspects of the invention discussed above, the clipboard may also include at least one member for removably attaching a writing implement (such as a pen or a pencil) to the board. The member is constructed to urge the implement against a paper stop disposed on the surface of the board adjacent to the clip. Preferably, at least two such members are provided—one on each side of the board to accommodate left-handed and right-handed writers.

Other features and advantages of the invention will become apparent from the following detailed description, and from the claims.

DESCRIPTION OF THE PREFERRED EMBODIMENTS

Figure 1:
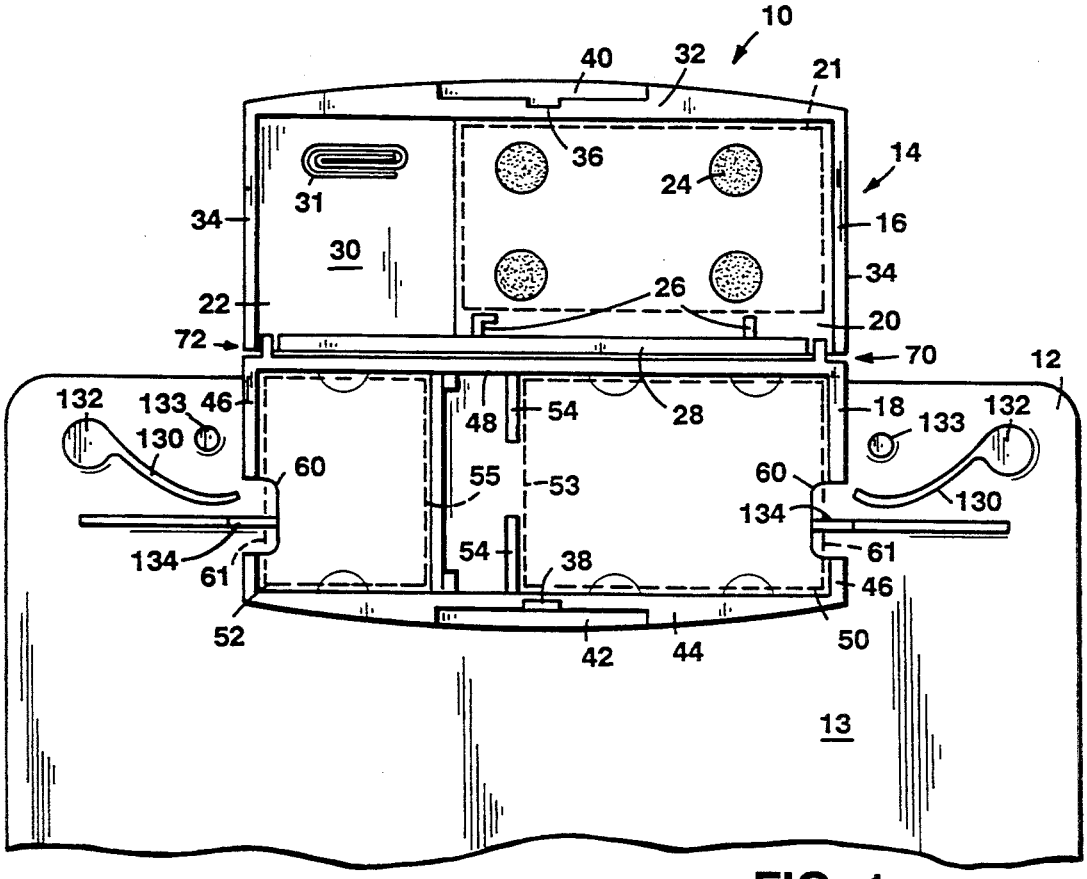
FIGS. 1 and 2 show a clipboard the clip of which includes a housing with a lid for providing access to objects stored in the housing; the lid is shown in the open position in FIG. 1 and in the closed position in FIG. 2.
Figure 2:
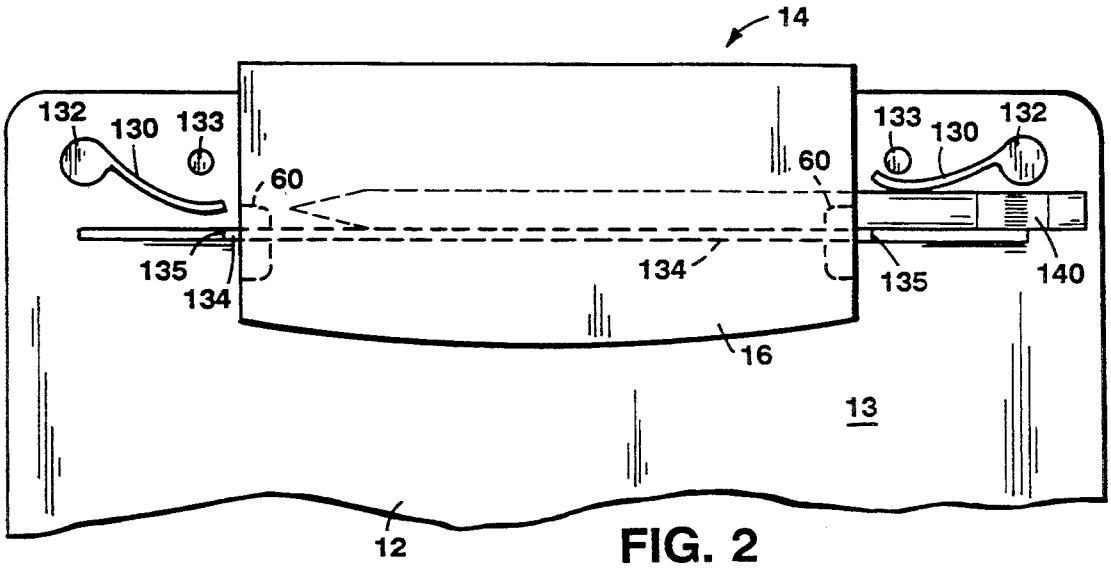

Referring to FIGS. 1 and 2, clipboard 10 includes a board 12 having suitable dimensions for supporting sheets of paper (e.g., $8\frac{1}{2}\times 11$ inches in size) and a clip 14 pivotally mounted to board 12 for clamping the sheets of paper to an upper surface 13 of board 12. Clip 14 is configured as a housing for storing therein a myriad of objects—such as paper articles (e.g., one or more stacks of memo sheets, business cards, etc.), paper clips, and electronic devices (such as a calculator or a clock). A lid 16 is pivotally mounted to a base 18 of clip 14 and is movable between an open position (shown in FIG. 1) in which a user has access to the objects stored in clip 14, and a closed position (FIG. 2) in which the lid prevents access to the stored objects.

As illustrated by FIG. 1, lid 16 and base 18 each includes multiple compartments for receiving the objects to be stored. More specifically, lid 16 is partitioned into a pair of compartments 20, 22 of different sizes. Compartment 20 is sufficiently large to accommodate an electronic device 21 (shown in phantom) such as a credit card-sized calculator or a clock. A series of circular velcro ® fasteners 24 are fixed to the interior surface of lid 16 to engage a corresponding series of fasteners (not shown) on the underside of device 21 to retain device 21 in place within clip 14 when lid 16 is open. (Alternatively, fasteners 24 may be fashioned as one or more strips.) A pair of spacers 26 serve to separate electronic device 21 from lower wall 28 of lid 16.

Compartment 22 is somewhat smaller than compartment 20 and receives a sheet magnet 30, which is adhered to the interior surface of lid 16. Magnet 30 helps retain metal objects—such a paper clips 31—in clip 14 when lid 16 is open.

Compartments 20, 22 are bounded by lower wall 28, upper wall 32, and a pair of side walls 34, each of which projects from the interior surface of lid 16 sufficiently to provide room for the objects to be stored therein. For example, walls 28, 32, 34 are 5/16 inch high. A slot 36 formed in wall 32 receives a corresponding tab 38 in base 18 to latch lid 16 closed. A semi-oval recess 40 in wall 32 (which matches a recess 42 in base 18) assists the user in gripping lid 16 to open clip 14 (see also FIG. 4). The upper edge of wall 32 is curved to provide a sleek appearance. Lid 16 is manufactured from injection molded plastic.

Base 18 is similar in dimensions to lid 16 and includes a lower wall 44, an upper wall 46, and a pair of side walls 48 that define a pair of compartments 50, 52 for storing additional objects, for example, stacks of memo sheets (such as the well-known Post-it ® memo sheets available from 3M Company). Lower wall 44 has a curved profile matching that of lid wall 32. The dimensions of compartment 50 are selected such that compartment 50 can accommodate either a single stack of $2\times 3$ inch memo sheets 53 (shown in phantom) or a pair of $1\frac{1}{2}\times 2$ inch stacks of memo sheets laid side by side (not. separately shown). Compartment 50 is bounded within base 18 by a pair of spaced ribs 54 which extend from a walls 44, 48, respectively.

Compartment 52 is sized to receive a $1\frac{1}{2}\times 2$ inch stack of memo sheets 55 (shown in phantom) and is bounded within base 18 by a ridge 56 that extends completely between walls 44, 48. Ridges 54, 56 are the same height but are shallower than walls 44–48 (which are the same height as the walls of lid 16). A pair of ribs 57 serve to reinforce walls 44, 48. As with lid 16, base 18 is formed from injection molded plastic.

Compartments 50, 52 each includes a set of thin, semicircular tabs 58 that extend inwardly from respective walls 44, 48 and that are spaced slightly above the interior surface of base 18. Tabs 58 serve as "hold-downs" to retain stacks 53, 55 of memo sheets within base 18 when lid 16 is open. That is, tabs 58 are elevated sufficiently to allow the lowermost sheet or two of stacks 53, 55 to be slid beneath tabs 58 when stacks 53, 55 are installed by the user. Tabs 58 hold each stack 53, 55 in place when the user removes the uppermost sheet in the stack (which is lightly adhered to the next sheet in the stack) or if clipboard 10 is turned upside down.

A pair of openings 60 are formed through side walls 46 and partially in underlying portions of the lower surface of base 18 to provide the user with easy access to stacks 53, 55 when lid 16 is open. That is, each opening 60 exposes an outer edge 61 of paper in a stack 53, 55 to allow the user to easily grasp the uppermost sheet of paper for removal.

Figure 3:
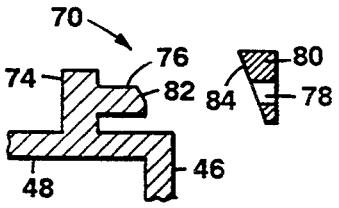
FIG. 3 illustrates details of a hinge between the lid and a base of the housing.

Referring also to FIG. 3, lid 16 is pivotally mounted to base 18 by a pair of hinges 70, 72. FIG. 3 shows hinge 70 in greater detail (it will be appreciated that hinge 72 is similarly constructed). An enlarged finger 74 molded to base wall 48 supports an integral pivot pin 76. A hole 78 in an enlarged tab 80 molded to lid wall 34 receives pin 76. Note that no separate pivot pins are used—the pivot pin (76) of each hinge 70, 72 is integrally formed as a single unit with base 18 during injection molding. Pivot pin 76 and tab 80 include a matched pair of inclined surfaces 82, 84, respectively, to facilitate the attachment of lid 16 to base 18. During assembly, tabs 80 of hinges 70, 72 are placed against fingers 74 of base 18 with inclined surfaces 82, 84 in contact. Lid 16 and base 18 are then urged together so that tabs 80 flex slightly outward and slide over pins 76 along inclined surfaces 80, 82 until pins 76 seat within holes 78.

Operation of clip 14 is simple. The user closes clip 14 simply by pivoting lid 16 about hinges 70, 72 until lid 16 rests on base 18, and then pressing lid 16 against base 18 until tab 38 snaps into slot 36. As will be appreciated from FIG. 4, with lid 16 closed, access to the objects stored within clip 14 is prevented. Although the user can touch edges 61 of note paper stacks 53, 55, he or she cannot remove the paper without opening lid 16.

The user opens clip 14 by placing his or her thumb within the space defined by recesses 40, 42 (FIG. 4) and pulling lid 16 upwardly with sufficient force to overcome the latch formed by tab 38 and recess 36. The user then pivots lid 16 fully open to expose the stored objects. He or she is then free to access the stored objects—e.g., remove memo sheets from stacks 53, 55 or add/remove paper clips 31, or use calculator 21). Walls 28, 44 are constructed to limit the movement of lid 16 so that, when open, lid 16 lies in the same plane as base 18.

Figure 4:
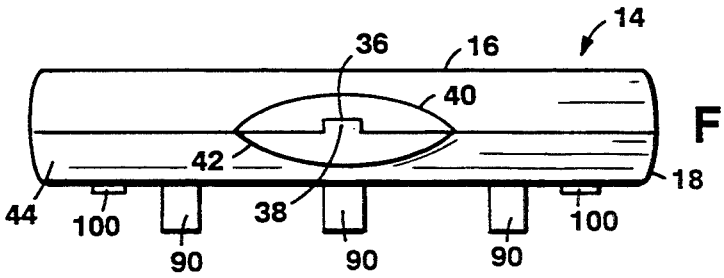
FIG. 4 is a front view of the clip.
Figure 5:
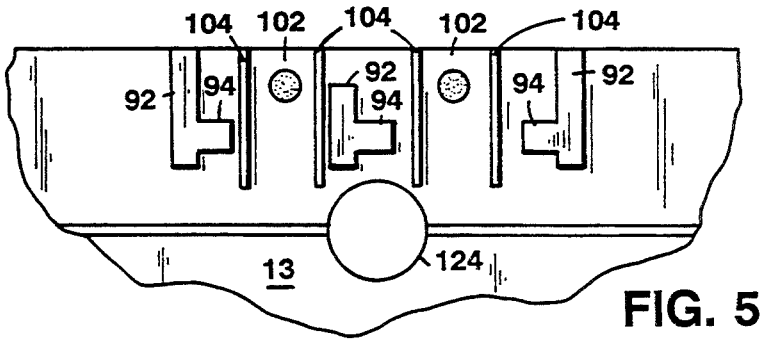
FIG. 5 shows a portion of the upper surface of the clipboard to which the clip is mounted.
Figure 6:
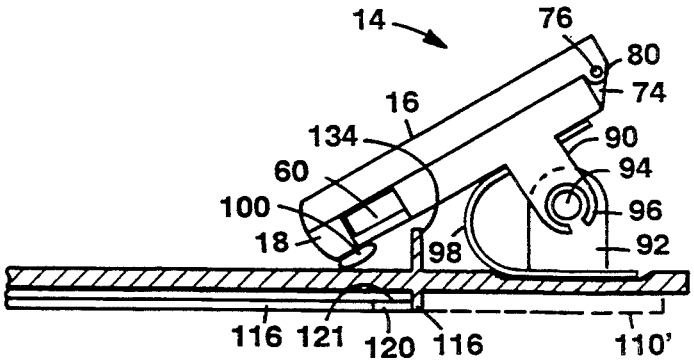
FIG. 6 is a partial cross-sectional view showing the clip mounted to the board.

Referring to FIGS. 4–6, the underside of base 18 is equipped with three integrally formed, vertically extending clasps 90 for attaching clip 14 to board 12. A corresponding set of three posts 92 on the upper end of board 12 supports horizontally extending pins 94 (i.e., pins 94 extend along an axis parallel to board 12). (Board 12, posts 92, and pins 94 are integrally formed as a single, unitary structure by injection molding.) Each clasp 90 includes a C-shaped end 96 that resiliently grasps a pin 94. (Ends 96 are open to allow clip 14 to be removed, if desired.) As a result, the need for separate pivot pins to complete the attachment of clip 14 to board 12 is eliminated. Note that pins 94 of the left- and right-most posts 92 (FIG. 4) face each other so that their posts 92 block clip 14 from sliding off of pins 94 horizontally.

A pair of V-shaped springs 98 (only one of which is shown in FIG. 6) fit between the underside of base 18 and surface 13 of board 12 to resiliently urge lower wall 44 of base 18 toward surface 13. A pair of rubber pads 100 formed on the underside of base 18 near wall 44 engage paper (not shown) disposed on board 12 to help hold the paper in place. Each spring 98 fits within a slot 102 (FIG. 5) defined by pairs of small ridges 104 on surface 13. A boss 106 in each slot 102 fits within a hole (not shown) in spring 98. The underside of base 18 includes a similar pair of slots and bosses (not shown) for engaging the opposite end of each spring 98. This arrangement helps maintain springs 98 in during use of clip 14.

The user operates clip 14 to release paper clamped by clip 14 to board 12 simply by pushing the raised end of clip 14 (FIG. 6) toward board 12 with sufficient force to overcome springs 98.

Clipboard 10 includes several other noteworthy features. For example, referring FIG. 7, a rectangular frame 110 is molded on the underside 15 of board 12 for holding informational material for the convenience of the user. For example, a sheet of paper 114 on which a calendar is printed is stored in frame 110 (of course, other informational material, such as charts, graphs, photographs, etc. may be used in place of a calendar). The walls 116 of frame 110 define an opening of any suitable size (e.g., $8\frac{1}{2}\times 11$) for sheet 114. Sheet 114 is held in place within frame 110 by a transparent plate 118 of plastic (or other suitable material), the four corners 119 of which are captured beneath curved overhangs 120 formed at the corners of frame 110.

Figure 8:
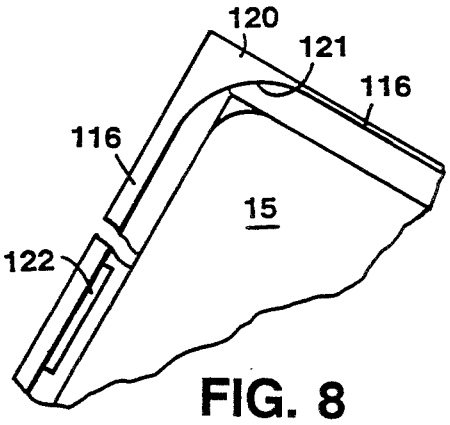
FIG. 8 shows portions of the frame of FIG. 7 in detail.

Overhang 120 is shown in more detail in FIGS. 6 and 8. Each wall 116 is slightly more than $\frac{1}{8}$ inch high with respect to lower surface 15. Overhang 120 is formed at the top of walls 116 and has a thickness selected to provide a $\frac{1}{8}$ inch space between it at surface 15. Each overhang 120 has a radius of curvature of $\frac{3}{8}$ inch to provide sufficient size to capture corner 119 while also allowing plate 118 to be removed for replacement of sheet 114. A set of eight thin ribs 122—two on each wall 116—(only one of which is shown in FIG. 8) helps retain plate 118 in place within frame 110 even if board 12 is twisted during use. Each rib 122 is elevated approximately $\frac{3}{8}$ inch from surface 15 on wall 116 so that plate 118 may fit beneath it. A circular hole 124 is formed in board 12 at the center of upper wall 116 of frame 110 for purposes described immediately below.

Plate 118 is removed from frame 110 as follows. The user cradles clipboard 10 in one arm (e.g., the right arm) with the lower edge of clipboard 10 supported (e.g., on the user's lap) and surface 15 facing the user. The fingers of the right hand are pressed firmly against the upper left hand corner of plate 118, and the thumb of the left hand is pressed firmly against the upper right hand corner of plate 118. The middle finger of the left hand is inserted through hole 124, curled around the upper edge of plate 118, and used to pull plate 118 away from board 12 at a right angle until the upper corners 119 of plate 118 are removed from overhangs 120.

Sheet 114 can then be freely removed and replaced with, e.g., an up-to-date calendar or other information. Plate 118 is re-installed by reversing the procedure discussed above. After corners 119 have been seated beneath overhangs 120, the user should press firmly along the edges of plate 118 to ensure that plate 118 is seated beneath all eight ribs 122.

Referring again to FIGS. 1 and 2, clipboard 10 also includes a pair of mechanisms—one on each side (left and right) of board 12—for securing writing implements (such as pens or pencils) to board 12. Each mechanism includes a resilient, S-shaped arm 130 supported on board 12 by a stationary footing 132 injection molded on board 12. Arms 130 are free to flex with respect to footing 132 (as described below) to the extent permitted by a pair of bosses 133 on surface 13. Arms 130 are spaced from a thin, elongated flange 134 that runs horizontally along upper board surface 13 and serves as a stop for paper clamped to the board by clip 14.

In use, a writing implement 140 (FIG. 2) is inserted between an arm 130 and flange 134 from the side (e.g., from the right in FIG. 2), thereby urging arm 130 toward boss 133. Arm 130 thus resiliently captures implement 14 against flange 134 to maintain implement 140 in place for easy access by the user. The height of flange 134 in regions adjacent to arms 130 is at least as great as the diameter of writing implement 140 (e.g., slightly greater than $\frac{3}{8}$ inch) to help ensure that implement 140 is securely held in place. Flange 134 steps down in height at shoulders 135 to ensure that flange 134 is cleared by clip 14 (see FIG. 6).

Other embodiments are within the scope of the following claims.

For example, numerous other types of objects may be stored in clip 14. Examples include mirrors, clocks, keys, telephone directories, and calendars, and other accessories, but this list is by no means exclusive.

More or fewer compartments than discussed above can be included in lid 16, base 18, or both. The relative sizes of the compartments may be varied according to the dimensions of the objects to be stored. Likewise, the dimensions discussed above (e.g., for board 12, clip 14, and frame 110) are purely illustrative and can be varied as desired.

Figure 7:
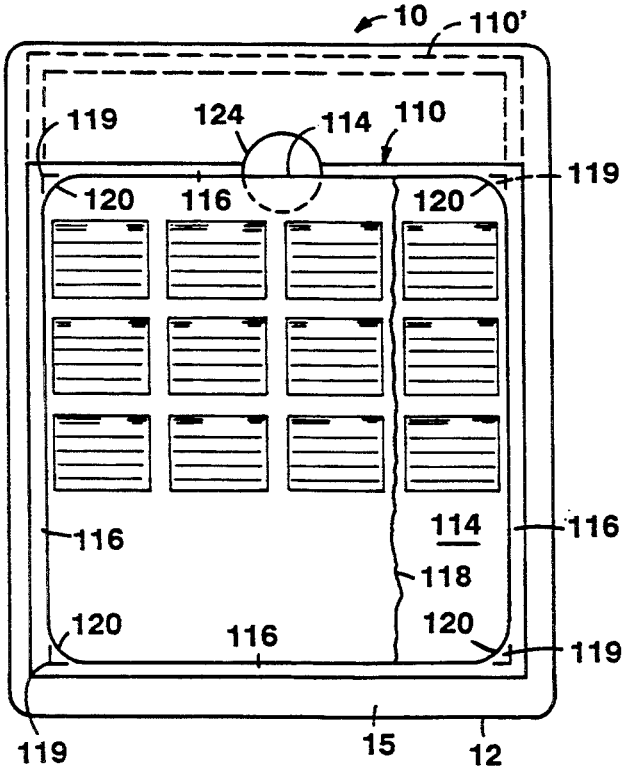
FIG. 7 illustrates a frame on the underside of the board that receives an object for display to the user.

Referring to FIGS. 6 and 7, an extension 110 of frame 110 may be formed beneath the upper edge of board 12. This will provide support for board 12 on each side of clip 14, thereby increasing the stability of board 12 during the use of clip 14.

Frame 110 may alternatively be formed on upper surface 13 of board 12.

What is claimed is:

1. A clipboard comprising a board for supporting paper, and a clip pivotally mounted to said board for clamping the paper to a surface of said board, said clip including a housing for storing an object therein, said housing having a lid that is selectively movable between a closed position, and an open position, said lid being configured to prevent said object from being inserted in or removed from said housing through said lid when said lid is in the closed position, whereby said object can be inserted into or removed from said housing only when said lid is in said open position.

2. The clipboard of claim 1 wherein said housing further comprises a base, said lid being pivotally mounted to said base for said selective movement between said closed position and said open position.

3. A clipboard comprising a board for supporting paper, and a clip pivotally mounted to said board for clamping the paper to a surface of said board, said clip including a housing for storing an object therein, said housing comprising a base and a lid that is pivotally mounted to said base for selective movement between a closed position in which said lid prevents access to said object and an open position in which said lid allows said object to be accessed, said housing further comprises a base, said lid and said base each including at least one compartment therein for storing at least one said object.

4. The clipboard of claim 3 wherein said lid and said base include a plurality of compartments each of which stores at least one said object.

5. The clipboard of claim 4 wherein said compartments have different dimensions to accommodate different types of objects.

6. The clipboard of claim 1 wherein said at least one object includes paper articles.

7. The clipboard of claim 6 wherein said housing further comprises a base, said lid being pivotally mounted to said base for said selective movement between said closed position and said open position, said base including at least one opening therein to facilitate access to said paper articles when said lid is in said open position.

8. The clipboard of claim 6 wherein said paper articles include a stack of memo sheets.

9. A clipboard comprising, a board for supporting paper, a clip pivotally mounted to said board for clamping the paper to a surface of said board, said clip including a housing for storing at least one object therein, said at least one object including paper articles in the form of a stack of memo sheets, said housing comprising a base and a lid pivotally mounted to said base for selective movement between a closed position in which said lid prevents access to said at least one object and an open position in which said lid allows said at least one object to be accessed, said base including at least one opening therein to facilitate access to said paper articles when said lid is in said open position, and at least one tab for engaging said stack of memo sheets to retain said stack within said housing when said lid is in said open position.

10. The clipboard of claim 6 wherein said paper articles include business cards.

11. The clipboard of claim 1 wherein said at least one object includes an electronic device.

12. A clipboard comprising a board for supporting paper, a clip pivotally mounted to said board for clamping the paper to a surface of said board, said clip including a housing for storing at least one object therein, said at least one object including an electronic device, said housing having a lid that is selectively movable between a closed position in which said lid prevents access to said object and an open position in which said lid allows said object to be accessed, and means for retaining said electronic device within said housing when said lid is in said open position.

13. The clipboard of claim 12 wherein said electronic device is a calculator.

14. A clipboard comprising a board for supporting paper, a clip pivotally mounted to said board for clamping the paper to a surface of said board, said clip including a housing for storing at least one object therein, said at least one object including metal paper clips, said housing having a lid that is selectively movable between a closed position in which said lid prevents access to said object and an open position in which said lid allows said object to be accessed, and a magnet disposed within said housing for retaining said paper clips within said housing when said lid is in said open position.

15. A clipboard comprising a board for supporting paper, a clip pivotally mounted to said board for clamping the paper to a surface of said board, said clip including a housing for storing an object therein, said housing comprising a base and a lid that is pivotally mounted to said base with a plurality of hinges to allow said lid to be selectively moved between a closed position in which said lid prevents access to said object and an open position in which said lid allows said object to be accessed, and at least one of said hinges including a pin on said base for engaging a hole disposed in an inclined mounting surface on said lid, said pin having an inclined surface that corresponds to said inclined mounting surface to facilitate attachment of said lid to said base.

16. A clipboard comprising a board for supporting paper, and a clip pivotally mounted to said board for clamping the paper to a surface of said board, said clip including a housing for storing an object therein, said housing comprising a base and a lid that is pivotally mounted to said base for selective movement between a closed position in which said lid prevents access to said object and an open position in which said lid allows said object to be accessed, said base including at least one pad for engaging and clamping the paper to said surface of said board.

17. A clip constructed to be mounted to a clipboard for clamping paper to a surface of the clipboard, comprising a housing for storing an object therein, said housing having a lid that is selectively movable between a closed position and an open position, said lid being configured to prevent said object from being inserted in or removed from said housing through said lid when said lid is in the closed position, whereby said object can be inserted into or removed from said housing only when said lid is in said open position.

18. A clipboard comprising a board for supporting paper, and a clip for clamping the paper to a surface of said board, an assembly for pivotally mounting said clip to said board, said assembly including at least one post integrally formed with said board so that said post and said board comprise a single, unitary structure, and at least one clasp disposed on said clip and constructed to resiliently grasp a portion of said post and permit said clip to pivot thereabout.

19. The clipboard of claim 18 wherein said portion of said post includes a pin disposed along an axis parallel to said surface of said board.

20. The clipboard of claim 19 further comprising at least a second said post having a pin facing said pin of the first-mentioned post, and at least a second said clasp for resiliently grasping said pin of said second post.

21. The clipboard of claim 18 further comprising a spring disposed between said clip and said surface of said board for resiliently urging a portion of said clip against said surface to clamp the paper to the board.

22. The clipboard of claim 21 further comprising means for retaining said spring in place between said clip and said board.

23. A clipboard comprising a board for supporting paper, a clip for clamping the paper to a surface of said board, a frame supported by said board, said frame including a plurality of walls that protrude from a generally flat surface of said board and which are spaced to receive an object therebetween for display to a user of said clipboard, and a transparent plate disposed within said frame between said walls, said frame having a lip disposed on said walls to capture a portion of said transparent plate therebeneath and retain said transparent plate and said object within said frame.

24. The clipboard of claim 23 wherein said lip is constructed to release said portion of said transparent plate and allow said transparent plate to be removed from said frame so that said object can be replaced.

25. The clipboard of claim 23 wherein said board has first and second generally flat surfaces disposed on opposite sides thereof, said frame being disposed on said first surface and said clip being disposed on said second surface.

26. The clipboard of claim 23 wherein said object includes a sheet of material having information thereon for observation by the user.

27. The clipboard of claim 1, 3, 9, 12, 14, 15, 16, 18, or 23 further comprising at least one member for removably attaching a writing implement to said board.

28. The clipboard of claim 27 further comprising a paper stop disposed on said surface of said board adjacent to said clip, said at least one member being constructed to urge the writing implement against said paper stop.

29. The clipboard of claim 28 further comprising a second said member disposed on a opposite side of said board from the first mentioned member.

30. The clipboard of claim 23 wherein said plurality of walls and abut each other at a corner of said frame, said lip being disposed on said walls at said corner.

31. The clipboard of claim 23 wherein said frame is integrally formed with said board so that said frame and said board comprise a single, unitary structure.

32. The clipboard of claim 27 wherein said at least one member is integrally formed with said board so that said member and said board comprise a single, unitary structure.

* * * * *